US008122790B1

(12) United States Patent
Johnson, Sr. et al.

(10) Patent No.: US 8,122,790 B1
(45) Date of Patent: Feb. 28, 2012

(54) INSULATED TOOL FOR LINESMEN

(75) Inventors: Archie T Johnson, Sr., Arcadia, FL (US); Trampus Fillingim, Arcadia, FL (US); Archie T. Johnson, III, Arcadia, FL (US)

(73) Assignee: Archie Johnson, Sr., Arcadia, FL (US)

( * ) Notice: Subject to any disclaimer, the term of this patent is extended or adjusted under 35 U.S.C. 154(b) by 0 days.

(21) Appl. No.: 13/199,030

(22) Filed: Aug. 18, 2011

(51) Int. Cl.
*B25B 13/46* (2006.01)

(52) U.S. Cl. ..... 81/60; 81/900

(58) Field of Classification Search ..... 81/60, 900, 81/61–63.2
See application file for complete search history.

(56) References Cited

U.S. PATENT DOCUMENTS 4,676,125 A * 6/1987 Ardelean ..... 81/53.2
(Continued)

*Primary Examiner* — David B Thomas

(57) ABSTRACT

A tool for linesmen who work on high powered electrical installations. The tool is constructed of a single handle at one end and a integral forked end at the other end. The forked end receives a ratchet mechanism with two outwardly placed sockets. The handle and the integral forked end is manufactured of an electrical insulating and hardened material.

2 Claims, 1 Drawing Sheet

U.S. PATENT DOCUMENTS 4,986,147 A * 1/1991 Cooper ..... 81/63.2
5,095,783 A * 3/1992 Majima ..... 81/165
5,359,911 A * 11/1994 Kruesi ..... 81/436
5,368,298 A * 11/1994 You ..... 473/536
5,448,932 A * 9/1995 Zurbuchen et al. ..... 81/124.4
5,606,897 A * 3/1997 Quinn ..... 81/124.6
5,626,061 A * 5/1997 Whitley ..... 81/63
5,713,251 A * 2/1998 Zurbuchen et al. ..... 81/61
5,875,693 A * 3/1999 Zurbuchen et al. ..... 81/63.2
6,216,566 B1 * 4/2001 Zurbuchen ..... 81/177.8
6,257,107 B1 * 7/2001 Chang et al. ..... 81/467
6,318,216 B1 * 11/2001 Eggert et al. ..... 81/61
6,943,301 B2 * 9/2005 Lee ..... 174/138 R
7,051,630 B2 * 5/2006 Lee ..... 81/451
2002/0011136 A1 * 1/2002 Eggert et al. ..... 81/125.1
2004/0177733 A1 * 9/2004 Peters ..... 81/490
2005/0022631 A1 * 2/2005 Brazil ..... 81/119
2005/0076748 A1 * 4/2005 Tremblay et al. ..... 81/177.8
2011/0030145 A1 * 2/2011 Mandic ..... 7/107

* cited by examiner

Fig, 2

INSULATED TOOL FOR LINESMEN

BRIEF DESCRIPTION OF THE INVENTION

The linesmen tool is well known and is constructed of a handle that has a forked and integral extension at its forward end. The forward end will receive a ratchet mechanism between the two parallel forks and through holes in both of the forks an extending rod has two different sockets attached thereto. The difference in arrangement lies in the fact that in the inventive construction of this tool, the basic handle and integral fork is made of a hardened but electrically insulating material that will protect the linesmen of any harm that may be caused by contact with high powered electricity.

BRIEF DESCRIPTION OF THE DRAWINGS

FIG. 2 shows the tool in an exploded view illustrating the handle including the integral fork which is the subject of this invention.

DETAILED DESCRIPTION OF THE INVENTION

Figure 1:
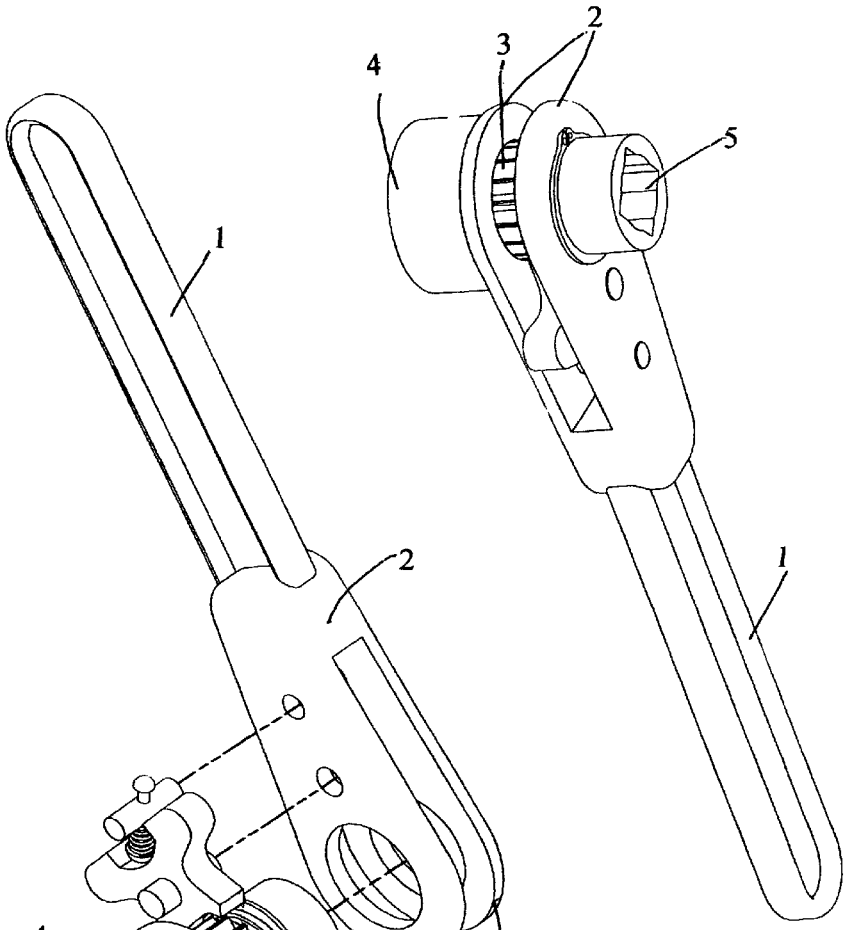
FIG. 1 is a perspective view of the tool completely assembled.

FIG. 1 is a perspective view of the tool including the integral handle 1 which is constructed of the hand held handle 1 and is integral with forked end 2. Between the forked elements there is located a ratchet mechanism 3, which is well known. The ratchet mechanism continues to either side of the forked elements and ends on either side into the requisite sockets 4 and 5 which are used on standardized bolts and nuts required in an installation.

The inventive concept lies in the insulating and hardened material being used in constructing the handle with the fork at the other end.

Various materials are contemplated to achieve the desired results.

A.B.S.: is an Acrylonitrile-Butadiene and Styrene combination which is used to form a common plastic often used to make housings or other mechanical parts. It is strong and rigid enough, when used in the above mentioned tool to withstand the rigorous use it is subjected to when the tool is used in its environment.

Acetates: have good electrical insulating properties.

Acrylics: Lucite, and Plexiglass are trade names for an acrylic which has use where toughness is required.

Beryllium Oxide: is a hard white ceramic-like material used as an electric insulator.

Ceramic: Ceramics are used to fabricate insulators, and circuit boards.

Delrin: This Dupont acetate resin is made from polymerized formaldehyde and finds use similar to Nylon. The material is rigid and has excellent mechanical and electrical properties making its use in appliances and electronics and other applications.

Nomex: Nomex is a Dupont aromatic polyamide with an operating temperature of over 200 degrees C. and with superb high voltage breakdown. This material is an excellent choice for standardization since it outperforms many other materials.

The above mentioned electrically insulating materials which perform well in tool applications which are subjected to rigorous use are well suited for the construction of the basic handle and fork on the linesmen tool.

BACKGROUND OF THE INVENTION

Linesmen working on high power electric lines have to be extremely careful not to come in contact with any of the electric wires. Many devices and schemes have been used and are in existence to help the linesmen to avoid any contact with high powered wires. It is known that some type of rubber blankets are hung over the wires in the vicinity where the linesmen are working. However, in come instances, contact must be made with the wires to install connectors that require bolts and nuts. The tool for this operation is known to be a ratchet tool having the requisite sockets on either side. However this tool, when originally manufactured, is not insulated and the linesmen wear either insulating gloves, or they place an insulating tube over the handle or they just wrap electrically insulating tape around the handle. In any event any of the above procedures are apt to malfunction or fail which would endanger the lives of the linesmen.

What we claim is:

1. A linesmen tool used on high electric power lines, said tool is constructed of a single handle at one end and an integral forked end at the other, a ratchet mechanism is installed between the forks of said forked end, an extension of said ratchet mechanism toward an outside has a socket attached on each side, the improvement comprising: the single handle and integral forked extension is made of an electrically insulating and hardened material.

2. The linesmen tool of claim 1, wherein the electrically insulating and hardened material is selected from the group of materials consisting of A.B.S., Acetate, Acrylic, Beryllium Oxide, Ceramic and Delrin.

* * * * *